US006036833A

United States Patent [19]

Tang et al.

[11] Patent Number: 6,036,833

[45] Date of Patent: Mar. 14, 2000

[54] ELECTROPLATING METHOD OF FORMING PLATINGS OF NICKEL

[76] Inventors: Peter Torben Tang, 1, H.P. Ørumsgade; Henrik Dylmer, 21, Dag Hammerskjölds Allé, both of DK-2100 Copenhagen Ø; Per Møller, 48, Kirkebakkegårdsvej, DK-3540 Lynge, all of Denmark

[21] Appl. No.: 08/973,556

[22] PCT Filed: Jun. 20, 1996

[86] PCT No.: PCT/DK96/00270

§ 371 Date: Dec. 22, 1997

§ 102(e) Date: Dec. 22, 1997

[87] PCT Pub. No.: WO97/00980

PCT Pub. Date: Jan. 9, 1997

[30] Foreign Application Priority Data

Jun. 21, 1995 [DK] Denmark ..... 0706/95

[51] Int. Cl.[7] ..... C25D 3/12; C25D 5/18

[52] U.S. Cl. ..... 205/103; 205/274

[58] Field of Search ..... 205/103, 274, 205/271

[56] References Cited

U.S. PATENT DOCUMENTS

| | | | |
|---|---|---|---|
| 2,470,775 | 5/1949 | Jernstedt et al. | 205/103 |
| 3,437,568 | 4/1969 | Hasselmann et al. | 205/67 |

FOREIGN PATENT DOCUMENTS

| | | |
|---|---|---|
| 0 079 642 A1 | 5/1983 | European Pat. Off. . |
| 2020840 A1 | 2/1971 | Germany . |
| 2218987 A1 | 11/1972 | Germany . |
| WO 94/12695 | 6/1994 | WIPO . |

OTHER PUBLICATIONS

F. A. Lowenheim, *Electroplating,* McGraw–Hill Book Co., New York, pp. 218–219 and 343–345, 1978 (month not available).

G. W. Jernstedt, Better Deposits at Greater Speeds by P R Plating, *Plating,* Jul. 1948.

Plating With Pulsed and Periodic–Reverse Current, Tai–P-ing Sun, et al., Metal Finishing, May, (1979), pp. 33–38.

W. Kleinekathoefer, et al. Metalloberfl. 9 (1982), pp. 411–420, month of publication not available.

Dalby, p. 16 Materialefordeling Ved Galvanoformgiving, publication date not available.

Watson, pp. 3–6 Compendium on nickel electroplating and Electroforming, publication date not available.

INCO, Nickel Electroforming, pp. 22–23, publication date not available.

*Primary Examiner*—Kathryn Gorgos
*Assistant Examiner*—William T. Leader
*Attorney, Agent, or Firm*—Oblon, Spivak, McClelland, Maier & Neustadt, P.C.

[57] ABSTRACT

An electroplating method of forming platings of nickel, cobalt, nickel alloys or cobalt alloys with reduced stress in a Watts bath, a chloride bath or a combination thereof, by employing pulse plating with periodic reverse pulses and a sulfonated naphthalene additive. This method makes it possible to deposit nickel, cobalt, nickel alloy or cobalt alloy platings without internal stress.

15 Claims, No Drawings

ELECTROPLATING METHOD OF FORMING PLATINGS OF NICKEL

TECHNICAL FIELD

The present invention relates to an electroplating method of forming platings of nickel, cobalt, nickel alloys or cobalt alloys in an electrodepositing bath of the type: Watt's bath, chloride bath or a combination thereof by employing pulse plating with a periodic reverse pulse. Current density independence is obtained by means of the invention, whereby low internal stresses are always rendered, wherever the measurement thereof is made on a particular member and whichever current density is used.

BACKGROUND ART

The most common electrodepositing baths for nickel electroplating are Watt's baths containing nickel sulfate, nickel chloride and usually boric acid; chloride baths containing nickel chloride and boric acid, and sulfamate baths containing nickel sulfamate, nickel chloride and usually boric acid. The latter baths are used for the more complicated platings and are difficult and comparatively expensive in use.

Corresponding platings of cobalt may be formed in similar baths containing cobalt sulfate and cobalt chloride instead of the corresponding nickel salts. By adding other metal salts platings of nickel or cobalt alloys are obtained.

It is known to employ a pulsating current, confer for instance W. Kleinekathöfer et al, Metalloberfl. 9 (1982), page 411–420, where pulse plating is used by alternating between equal periods of a direct current with a current density of 1 to 20 A/dm$^2$ and non-current periods, the pulse frequency being from 100 to 500 Hz. By employing a pulsating current and as result of the individual current impulses, an increased formation of crystal nucleuses is obtained, thus rendering a more fine-grained and hard plating.

It is furthermore known to employ pulse plating with periodic reverse pulse, i.e. alternating between a cathodic and anodic current. In the cathodic current cycle, the desired plating formation is obtained by metal deposition, while a portion of the deposited nickel is removed by dissolution in the anodic current cycle, any nodules in the plating thus being smoothed. In order to ensure that the, result is a build-up and not a dissolution of the plating, it is appreciated that the anodic load is to be less than the cathodic load. This method is e.g. described by Sun et al., Metal Finishing, May, 1979, page 33–38, whereby the highest degree of hardness in the plating is obtained at a ratio between the cathodic and the anodic current density of 1:1 with cathodic cycles $T_K$ of 60 msec. alternating with anodic cycles $T_A$ of 20 msec.

U.S. Pat. No. 2,470,775 (Jernstedt et al.) discloses a process for electroplating nickel, cobalt and alloys thereof in an electrodepositing bath containing chlorides and sulfates of the metals. The plating is effected by means of reversed pulse resulting in an improved appearance (smoothness and maximum brightness) as well as in an expedited deposition. An anodic current density is employed of substantially the same range as the cathodic current density. Various additives are mentioned in the U.S. patent, including naphthalene-1, 5-disulfonic acid. These additives are referred to as advantageous components, however no directions are rendered in connection with these additives or elsewhere in the patent as to how the mechanical internal stresses are reduced in the platings resulting from electroplating.

EP patent No. 0.079.642 (Veco Beheer B.V.) relates to pulse plating with nickel in an electrolytic bath of the Watt's bath type comprising butynediol or ethylene cyanohydrin as brightener. The deposition is preferably performed at a pulsating current without anodic cycles, but it is stated that anodic cycles, i.e. reverse pulse, can also be employed with the same result. It is, however, not possible to use long anodic pulses in a pure Watt's bath without passivating the nickel layer, whereby any further deposition is prevented. Moreover, said patent discloses that the frequencies used are in a range from 100 to 10,000 Hz.

None of the above mentioned publications relate to internal stresses in platings. U.S. Pat. No. 3,437,568 relates to a method for measuring the internal stresses in electroformed parts, but does not advise how to reduce the internal stresses and does not relate to pulse plating, additives or special nickel baths.

DE published specification No. 2.218.967 discloses a bath for electrodeposition of nickel, to which bath a comparatively large amount of sulfonated naphthalene is added, such as from 0.1 mole/l to saturation so as to reduce the internal stresses in the platings applied by electroplating and with a direct current of e.g. 30 or 60 mA/cm$^2$ corresponding to 3 to 6 A/dm$^2$. According to the publication, the internal stresses are only reduced from the undesired tensile stress range to the compressive stress range from 0 to 26,000 psi (approx. 179 MPa) by employing this bath.

Usually, the use of said additive only results in a reduction in the stresses in the range from approx. 300 MPa tensile stress to 100 MPa compressive stress and the stress curve is merely moved downward, but is still a function of the current density, which is a normal condition for any type of nickel bath with or without additives.

The use of the large amount of additive is, however, also encumbered with several drawbacks, since the additive is expensive, has detrimental effects on the environment and may cause damage to the bath.

Thus, an electroplating method, wherein the internal stresses are independent of the current density, cannot be deduced from the teachings of DE 2.218.967. When electroplating members of a simple geometric shape, often comparatively modest variations in the current density occur over different areas of the surface of the members. However, this is not possible when dealing with more complicated geometric shapes, wherein the method according to DE 2.218.967 cannot be employed in practise.

Internal mechanical stress is a problem in all nickel and cobalt depositions, even though the process can be controlled satisfactorily in some instances (by means of expensive electrolytes (sulfamate bath), temperature control, concentration, etc.) when dealing with simple geometric shapes. The prior art methods are, however, completely inapplicable for the manufacture of tools for injection moulding, micro mechanical components or similar complicated geometric shapes.

Consequently, it is desirable to provide a method, whereby nickel, cobalt, nickel or cobalt alloys can be deposited with substantially reduced or completely without internal stresses—even in complicated geometric shapes. It is also desirable that this result is obtained whichever current density is used for the deposition.

DISCLOSURE OF THE INVENTION

The present invention relates to an electroplating method of forming platings of nickel, cobalt, nickel or cobalt alloys in an electrodepositing bath belonging to the type of a Watt's bath, a chloride bath or a combination thereof by employing pulse plating with periodic reverse pulse, said method being characterised in that the electrodepositing bath contains an additive selected among sulfonated naphthalenes.

By employing the method according to the invention internal stresses which constitutes a serious problem can be avoided when forming said platings on geometric shapes of a more complicated structure.

BEST MODE FOR CARRYING OUT THE INVENTION

Sulfamate baths are more complicated (difficult and more expensive to maintain), but are generally used to reduce the stress in the platings. However, in a sulfamate bath, it is only possible to obtain platings with satisfactorily low internal mechanical stresses in case of simple geometric shapes.

Although sulfamate baths are also used in more complicated geometric shapes, as these present the hitherto best known solution, often the result is not the optimum due to heavy internal stresses in the plating which e.g. may cause deformation or cracks.

Sulfamate baths cannot be used for periodic reverse pulse deposition, sulfur alloyed anodes (2% S) being employed to prevent the sulfamate from decomposing into ammonia and sulfuric acid (ruining the bath). If the current is reversed, the cathode coated with non-sulfur alloyed nickel or cobalt becomes an anode and the sulfamate is destroyed.

When using a Watt's bath, a chloride bath or a combination thereof, it is not possible to obtain platings using a direct current without tensile stresses. In sulfamate baths the stress in the plating—from compressive stress through stress-free to tensile stresses—depends on the cathodic current intensity $I_K$. Consequently, on simple geometric shapes stress-free platings can be obtained by means of a sulfamate bath at a specific $I_K$ which depends on the temperature and may e.g. be of approximately 10 A/dm$^2$, but on more complicated geometric shapes this current intensity $I_K$ is not distributed evenly on the entire surface of the member and causes internal stresses.

The use of the combination according to the invention has surprisingly shown that the internal stresses are very small and independent of the cathodic current intensity $I_K$ and thus of the current distribution on the surface. As a result, low internal stresses are obtained wherever on the member the internal stress is measured and independent of the actual local current densities.

In this manner, the invention renders it possible to manufacture complicated geometric shapes completely without or with considerably reduced internal stresses in the plating.

As additive in the method according to the invention, sulfonated naphthalene is used, i.e. naphthalene sulfonated with from 1 to 8 sulfonic acid groups (—$SO_3H$), preferably with 2 to 5 sulfonic acid groups, most preferred 2–4 sulfonic acid groups. In practice, a sulfonated naphthalene product usually comprises a mixture of sulfonated naphthalenes with various degrees of sulfonation, i.e. the number of sulfonic acid groups per naphthalene residue. Moreover, several isomeric compounds may be present for each degree of sulfonation.

Typically, the used sulfonated naphthalene sulfonide has a degree of sulfonation on average corresponding to from 2 to 4.5 sulfonic acid groups per molecule, e.g. 2.5- to 3.5 sulfonic acid groups per molecule.

In the presently preferred embodiment of the invention, a mixture of sulfonated naphthalenes is used as sulfonated naphthalene additive, said mixture according to analysis containing approximately 90% of naphthalene trisulfonic acid, preferably comprising naphthalene-1,3,6-trisulfonic acid and naphthalene-1,3,7-trisulfonic acid.

The naphthalene residue in the sulfonated naphthalene additive is usually free of other substituents than sulfonic acid groups. Any other substituents may, however, be present provided that they are not detrimental to the beneficial effect of the sulfonated naphthalene additive on minimizing the internal stresses in the plating formed by employing pulse plating.

In a particular preferred embodiment according to the invention, the sulfonated naphthalene additive is used in the electroplating bath in the amount of 0.1 to 10 g/l, more preferred in an amount of 0.2 to 7.0 g/l and most preferred in an amount of 1.0 to 4.0 g/l, e.g. around 3.1 g/l.

Moreover, according to the invention the bath composition preferably contains 10–500 g/l of $NiCl_2$, 0–500 g/l of $NiSO_4$ and 10–100 g/l of $H_3BO_3$, more preferable 100–400 g/l of $NiCl_2$, 0–300 g/l of $NiSO_4$ and 30–50 g/l of $H_3BO_3$ and preferable 200–350 g/l of $NiCl_2$, 25–175 g/l of $NiSO_4$ and 35–45 g/l of $H_3BO_3$, for instance about 300 g/l of $NiCl_2$, 50 g/l of $NiSO_4$ and 40 g/l of $H_3BO_3$.

It has proved advantageous that the anodic current density $I_A$ is at least 1.5 times the cathodic current density $I_K$, more preferable when $I_A$ ranges from 1.5 to 5.0 times the $I_K$ and most preferable when $I_A$ is 2 to 3 times the $I_K$.

In a preferred embodiment, the method according to the invention may be characterised in that the pulsating current is made up of cathodic cycles, each of a duration $T_K$ of from 2.5 to 2000 msec. and at a cathodic current density $I_K$ of 0.1 to 16 A/dm$^2$ alternating with anodic cycles, each of a duration of from 0.5 to 80 msec. and at an anodic current density $I_A$ of 0.15 to 80 A/dm$^2$. A more preferable embodiment according to the invention is obtained when among the pulse parameters the $I_K$ ranges from 2 to 8 A/dm$^2$, the $T_K$ ranges from 30 to 200 msec., the $I_A$ ranges from 4 to 24 A/dm$^2$ and $T_A$ ranges from 10 to 40 msec. A particular preferred embodiment is obtained when $I_K$ is from 3 to 6 A/dm$^2$, $T_K$ is from 50 to 150 msec., $I_A$ is from 7 to 17 A/dm$^2$ and $T_A$ is from 15 to 30 msec., e.g. when $I_K$ is 4 A/dm$^2$, $T_K$ is 100 msec., $I_A$ is 10 A/dm$^2$ and $T_A$ is 20 msec.

EXAMPLES

Example 1

A nickel bath containing 300 g/l of $NiCl_2.6H_2O$ and 50 g/l of $NiSO_4.6H_2O$ was admixed, and to which bath 40 g/l of $H_3BO_3$ and 3.1 g/l of sulfonated naphthalene additive of technical grade comprising 90% naphthalene-1,3,6/7-trisulfonic acid were added.

Nickel was deposited on a steel strip fixed in a dilatometer so that the internal stresses in the deposited nickel can be measured as a contraction or a dilation of the steel strip. The temperature of the bath was 50° C. When nickel was deposited from said bath at a pulsating current having the cathodic pulse of 100 msec. and 3.5 A/dm$^2$ followed by an anodic pulse of 20 msec. and 8.75 A/dm$^2$, the internal stresses were measured to be 0 MPa or less than the degree of accuracy of the apparatus of approximately ±10 MPa.

Example 2

Following the method according to Example 1 with the exception that only 1.1 g/l of the same sulfonated naphthalene additive was used, the same result was obtained as in Example 1, i.e. that the internal stresses were to measure to 0 MPa or less than the degree of accuracy of the apparatus of approximately ±10 MPa.

Example 3

Following the method according to Example 2 with the exception that the anodic current density $I_A$ and the cathodic current density $I_K$ was set at 1.25 A/dm$^2$ and 0.5 A/dm$^2$ respectively, the same result as in Example 1 was obtained, i.e. that the internal stresses were measured to 0 MPa or less than the degree of accuracy of the apparatus of approximately ±10 MPa.

Example 4

Following the method according to Example 3 with the exception that the anodic current density $I_A$ and the cathodic current density $I_K$ was set at 18.75 A/dm$^2$ and 7.5 A/dm$^2$ respectively, the same result as in Example 1 was obtained, i.e. that the internal stresses were measured to 0 MPa or less than the degree of accuracy of the apparatus of approximately ±10 MPa.

Example 5

Using the method according to Example 1, in which the nickel bath containing 300 g/l of $NiCl_2$.6H2O and 50 g/l of $NiSO_4.6H_2O$ is substituted by 300 g/l of $CoCl_2.6H_2O$ and 50 g/l of $CoSO_4.6H_2O$ and the same amount of $H_3BO_3$ and sulfonated naphthalene additive, similar cobalt platings can be produced which are expected to have the similar low internal stresses.

Example 6

Following the method according to Example 5 with the exception that 1.1 g/l of sulfonated naphthalene additive was used, similar stress-free cobalt platings may be expected.

Example 7

Following the method according to Example 6 with the exception that the anodic current density $I_A$ and the cathodic current density $I_K$ was set at 1.25 A/dm$^2$ and 0.5 A/dm$^2$ respectively, similar stress-free cobalt platings can be expected.

Example 8

Following the method according to Example 7 with the exception that the anodic current density $I_A$ and the cathodic current density $I_K$ was set at 18.75 A/dm$^2$ and 7.5 A/dm$^2$ respectively, similar stress-free cobalt platings are expected.

Comparison Examples

Comparison Example 1

Employing the same set-up and materials as in Example 1, but at a direct current of 4 A/dm$^2$, the internal stresses for comparison with said Example were measured to 377 MPa.

Comparison Example 2

Employing the same set-up and materials as in Example 2, but using a direct current of 7.5 A/dm$^2$, the internal stresses were measured to 490 MPa.

Comparison Example 3

Employing the same set-up and materials as in Example 2, but instead using a pulsating current without reverse pulse ($I_K$=3.5 A/dm$^2$, $T_K$=100 msec., $I_A$=0 A/dm$^2$, $T_A$=20 msec.), the internal stresses were measured to 410 MPa.

We claim:

1. An electroplating method comprising forming platings of nickel in a chloride-sulfate-boric acid electrodepositing bath by employing pulse plating with periodic reverse pulsating current made up of cathodic cycles, each of a duration $T_K$ of from 2.5 to 2000 msec. at a pulsating or uniform cathodic current density $I_K$ of 0.1–16 A/dm$^2$ alternating with anodic cycles, each of a duration $T_A$ of from 0.5 to 80 msec. at an anodic current density $I_A$ of 0.15–80 A/dm$^2$, wherein the electrodepositing bath contains sulfonated naphthalene as an additive in an amount of 0.1 to 10 g/l and the anodic current density $I_A$ at least 1.5 times the cathodic current density $I_K$.

2. Method according to claim 1, wherein the sulfonated naphthalene has an average degree of sulfonation of 1 to 6 sulfonic acid groups per naphthalene residue.

3. Method according to claim 2, wherein the sulfonated naphthalene has an average degree of sulfonation of 2 to 5 sulfonic acid groups per naphthalene residue.

4. Method according to claim 2, wherein the sulfonated naphthalene has an average degree of sulfonation of 2 to 4.5 sulfonic acid groups per naphthalene residue.

5. Method according to claim 2, wherein the sulfonated naphthalene has an average degree of sulfonation of 2.5 to 3.5 sulfonic acid groups per naphthalene residue.

6. Method according to claim 2, wherein the sulfonated naphthalene comprises about 90% of naphthalene trisulfonic acid, wherein said naphthalene trisulfonic acid is a mixture of naphthalene-1,3,6-trisulfonic acid and naphthalene-1,3,7-trisulfonic acid.

7. Method according to claim 1 wherein the bath composition comprises 10 to 500 g/l of $NiCl_2$, 25 to 500 g/l of $NiSO_4$ and 10 to 100 g/l of $H_3BO_3$.

8. Method according to claim 1, wherein the anodic current density $I_A$ is from 1.5 to 5.0 times the cathodic current density $I_K$.

9. Method according to claim 1, where the pulsating current is made up of cathodic cycles, each of a duration $T_K$ of from 30 to 200 msec. at a cathodic current density $I_K$ of 2–8 A/dm$^2$ alternating with anodic cycles, each of a duration $T_A$ of from 10 to 40 msec. at an anodic current density $I_A$ of 5 to 20 A/dm$^2$.

10. Method according to claim 9, wherein the pulse parameters $I_K$, $T_K$, $I_A$, $T_A$ are 4 A/dm$^2$, 100 msec., 10 A/dm$^2$ and 20 msec., respectively.

11. Method according to claim 1, wherein the bath composition comprises 100 to 400 g/l of $NiCl_2$, 25 to 300 g/l of $NiSO_4$ and 30–50 g/l of $H_3BO_3$.

12. Method according to claim 1, wherein the bath composition comprises 200 to 350 g/l of $NiCl_2$, 25 to 175 g/l of $NiSO_4$ and 35 to 45 g/l of $H_3BO_3$.

13. Method according to claim 1, wherein the anodic current density $I_A$ is from 2.0 to 3.0 times the cathodic current density $I_K$.

14. Method according to claim 1, wherein the additive is used in an amount of 0.2 to 7.0 g/l.

15. Method according to claim 1, wherein the additive is used in an amount of 1 to 4 g/l.

* * * * *